US006364175B2

(12) United States Patent
Bloom

(10) Patent No.: US 6,364,175 B2
(45) **Date of Patent: *Apr. 2, 2002**

(54) PUMP DISPENSER PISTON PROVIDED WITH A PLASTIC INLET CHECK VALVE INSERT

(75) Inventor: Kenneth S. Bloom, Jerry City, OH (US)

(73) Assignee: Owens-Illinois Closure Inc., Toledo, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/860,512

(22) Filed: May 21, 2001

Related U.S. Application Data

(63) Continuation of application No. 09/425,482, filed on Oct. 22, 1999, now Pat. No. 6,234,361.

(51) Int. Cl.[7] ..... B67D 5/40

(52) U.S. Cl. ..... 222/383.1; 239/333

(58) Field of Search ..... 222/383.1; 239/333

(56) References Cited

U.S. PATENT DOCUMENTS

| | | | | | |
|---|---|---|---|---|---|
| 3,768,734 | A | * | 10/1973 | Anderson, Jr. et al. | 222/383 |
| 4,161,288 | A | * | 7/1979 | McKinney | 222/380 |
| 4,313,568 | A | * | 2/1982 | Shay | 222/380 |
| 4,358,057 | A | * | 11/1982 | Burke | 239/333 |
| 4,558,821 | A | * | 12/1985 | Tada et al. | 239/333 |
| 5,423,460 | A | * | 6/1995 | Thomann | 222/382 |
| 5,497,915 | A | * | 3/1996 | Wass | 222/153.07 |
| 5,884,820 | A | * | 3/1999 | Thanisch et al. | 222/383 |
| 6,123,236 | A | * | 9/2000 | Bloom | 222/341 |
| 6,234,361 | B1 | * | 5/2001 | Bloom | 222/383.1 |

* cited by examiner

*Primary Examiner*—Joseph A. Kaufman

(57) ABSTRACT

This pump dispenser has a piston with a central inlet opening connected to a tubular piston stem. A one-piece plastic check valve insert comprises a rim secured to the piston around the inlet opening and a hub which selectively seals the opening. The rim and hub are resiliently connected by zig-zag spokes.

4 Claims, 2 Drawing Sheets

PUMP DISPENSER PISTON PROVIDED WITH A PLASTIC INLET CHECK VALVE INSERT

CROSS REFERENCE TO RELATED APPLICATION

This application is a continuation of application Ser. No. 09/425,482 filed Oct. 22, 1999 now U.S. Pat. No. 6,234,361.

FIELD OF THE INVENTION

This invention relates to a pump dispenser of the type sometimes called a "trigger sprayer" in which the piston reciprocates vertically and is provided with a downward tubular inlet stem connected to an opening in the piston head. Liquid passes through the tubular stem and opening into the cylinder chamber. More specifically, this invention relates to the structure of the piston and an inlet check valve insert installed on such a piston and adapted to close the opening.

BACKGROUND OF THE INVENTION

The prior art, of course, is replete with varieties of manual pump dispensers adapted to pump liquid out a discharge orifice from a container on which the dispenser is mounted. One variety of such a dispenser is shown in the McKinney U.S. Pat. No. 4,161,288 in which the piston comprises a tubular inlet stem leading up to an opening in the piston head through which liquid passes into the pumping chamber. The piston seal is in the form of a plastic insert which seals the piston to the cylinder wall. The seal includes a central check plug aligned with the opening by webs integral with the piston seal and plug.

When the piston is raised by the trigger, the central plug seats on the opening blocking exit of the liquid back through the inlet. It raises on the downstroke to permit liquid to flow into the chamber.

Other check valves on the piston have included a steel ball operable in a special chamber and small enough to raise to permit passage of liquid on the downstroke, but dropping to close the tubular stem on the upstroke.

SUMMARY OF THE INVENTION

The invention is defined in the claim language. To be brief, the invention is a pump dispenser comprising a cylinder and piston assembly. The assembly is defined by a piston head and a tubular downward stem adapted to pass liquid up through an opening in the center of the piston head and into the cylinder chamber. A plastic check valve insert is installed in the upper side of the piston head. It comprises a one-piece molded wheel-like element including a securing rim fitting into an annular trough in the piston head, a central hub adapted to valve off the opening at the top of the tubular stem and a plurality of zig-zag spokes connecting the rim to the hub. These zig-zag spokes may each be in the form of arcuate portions concentric with the axis of the piston and inner and outer radial portions integral with the ends respectively of the arcuate portion.

BRIEF DESCRIPTION OF THE DRAWINGS

Further objects and features of the invention will be clear to those skilled in the art from a review of the following specification and drawings, all of which present a non-limiting form of the invention. In the drawings.

DESCRIPTION OF THE PREFERRED EMBODIMENT

Figure 1:
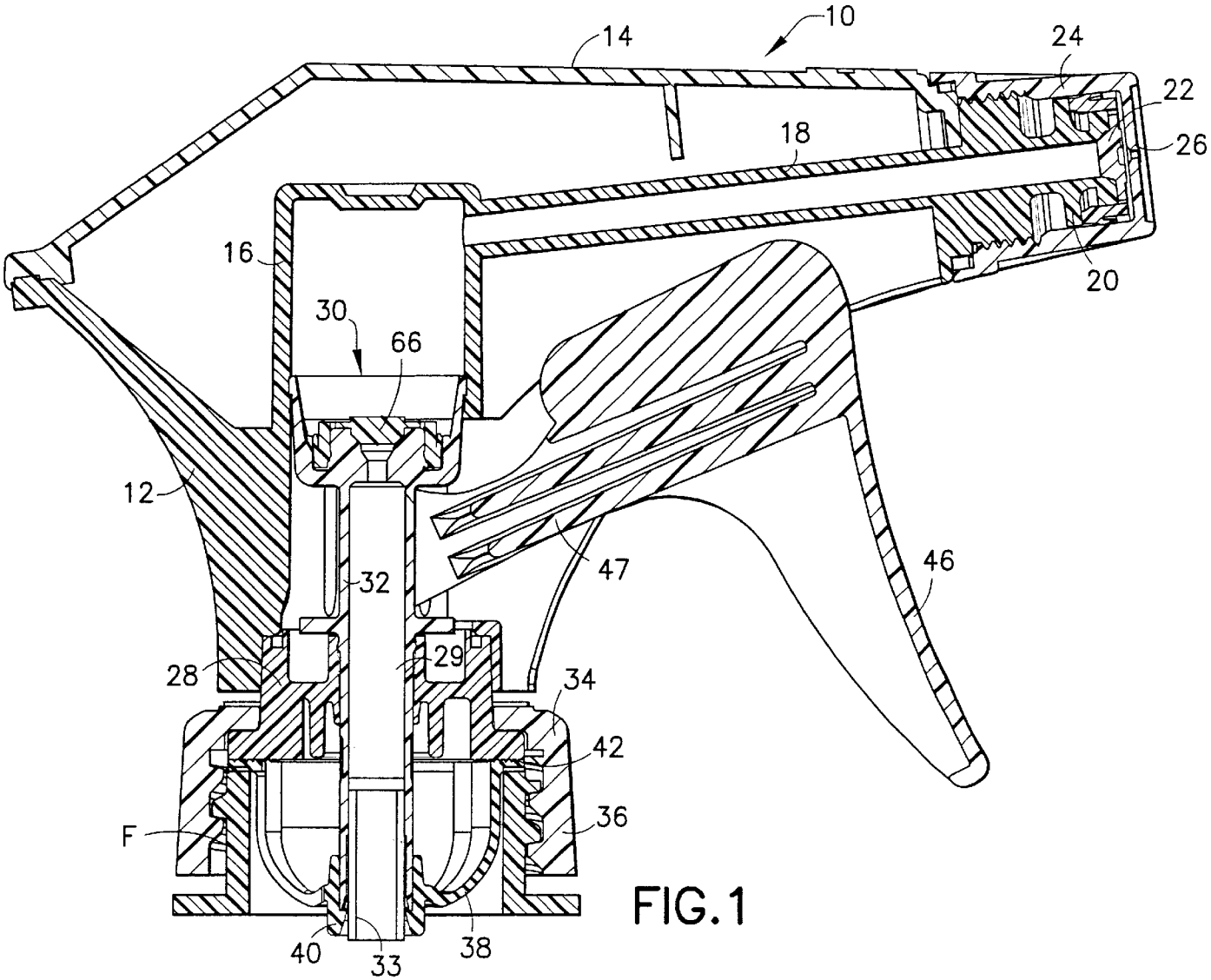
FIG. 1 is a sectional view of a pump dispenser embodying the invention.

A pump dispenser embodying the invention is shown in FIG. 1 and generally designated 10. It comprises a lower body portion 12 and a body cover 14. Integral with the body portion is the inverted-cup-shaped cylinder 16, the lower end of which is open.

From the upper end of the cylinder a delivery tube 18 extends forward to a nozzle fitting 20. The fitting carries an operative discharge check valve 22 as described, for instance, in the U.S. Pat. No. 4,313,568 which issued Feb. 2, 1982 to Joseph Shay and which is assigned to the assignee of the present application. The fitting and valve are enclosed in a nozzle cap 24 which, depending on its position, controls the form of discharge, i.e. stream, spray, etc. The discharge path includes the usual swirl chamber and orifice 26.

The lower body portion 12 is secured to the upper end of the spool-like retainer 28 which has a central opening 29. The pump piston is generally designated 30 and is operatively disposed in the cylinder 16. It includes a tubular stem 32 which extends through the opening in the retainer and which is coupled to a downward dip tube 33. The retainer has an outward flange 34 which holds captive a closure 36 rotatable thereon.

A basket-shaped spring 38 of resilient plastic is centrally secured to the lower end of the tubular stem 32 by an inner ring 40 as described in U.S. pending patent application Ser. No. 09/298,596 filed Apr. 23, 1999 by Kenneth S. Bloom and assigned to the assignee of the present application. The spring 38 is formed with an outer ring 42 and in use the flange 34 and the outer ring 42 are sealingly clamped to the finish F of a container (not shown).

In opposition to the spring 38, the piston 30 is raised by finger pressure on the trigger 46 having the piston-raising arm 47 and pivoted to the lower body portion 12.

Turning now to an essential of the present invention, the piston 30 comprises (FIG. 2), aside from the tubular stem 32, a piston head 50. The head is provided with a thickened periphery 52 to sealingly engage the inner surface of the cylinder 16. Formed internally on the head 50 is an upward central cylindrical boss 53. The boss is formed with a central opening 54 surrounded by a bevelled annular seat 56. The opening 54 communicates with the axial passage of the tubular stem 32.

The boss 53 is provided on its exterior wall 58 with an annular wall formed with an outward circumferential rib 60. Outward from the boss the piston head is formed with an annular wall 62 generally parallel to the wall 58 of the boss. Between them the walls 58 and 62 define an annular trough 64.

Figure 2:
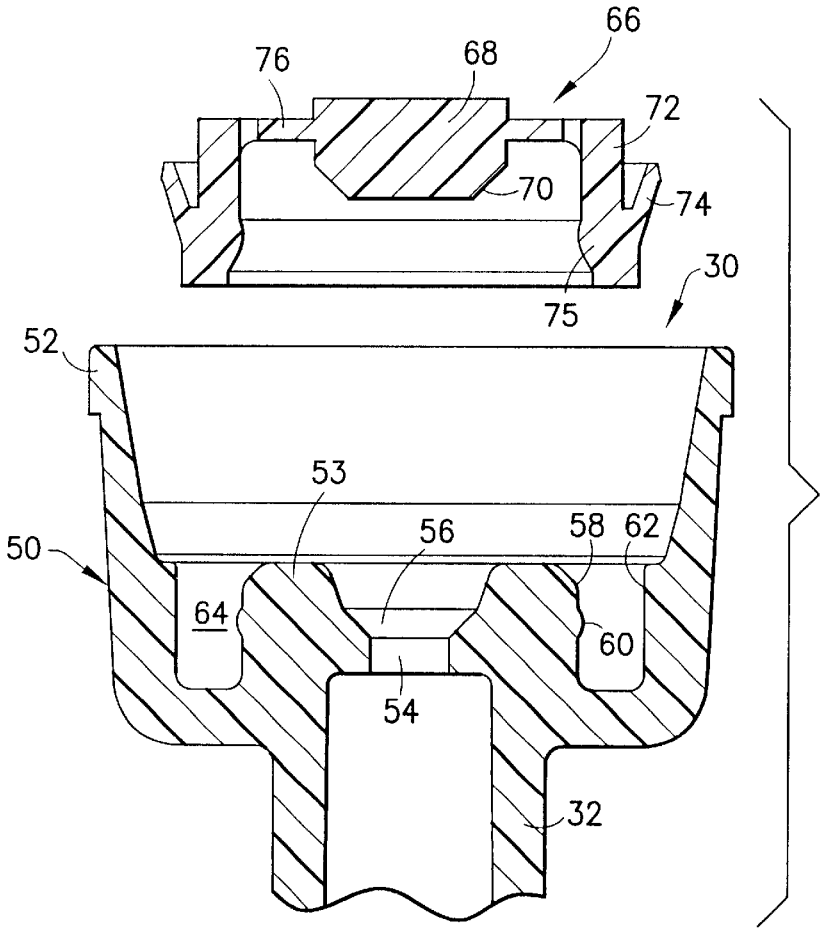
FIG. 2 is an enlarged exploded fragmentary view in section of the pump and check valve.
Figure 3:
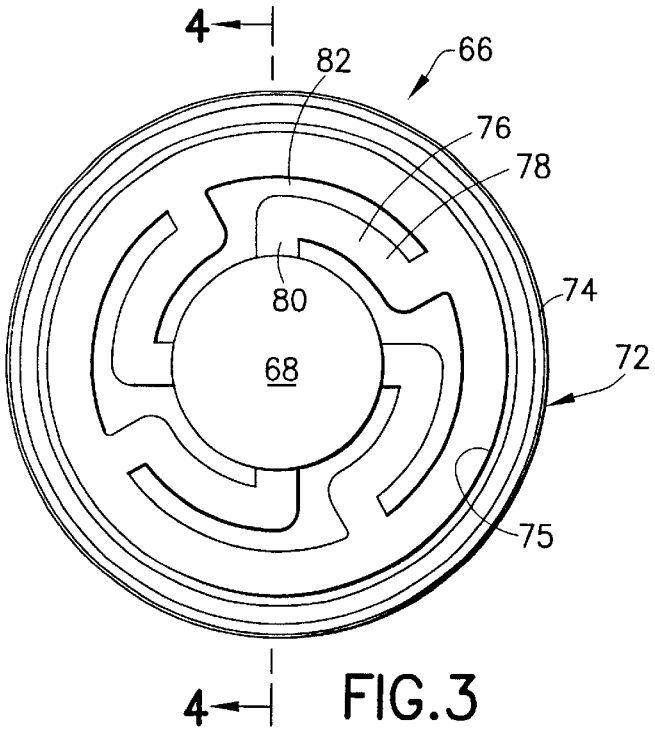
FIG. 3 is a greatly enlarged top plan view of the check valve.
Figure 4:
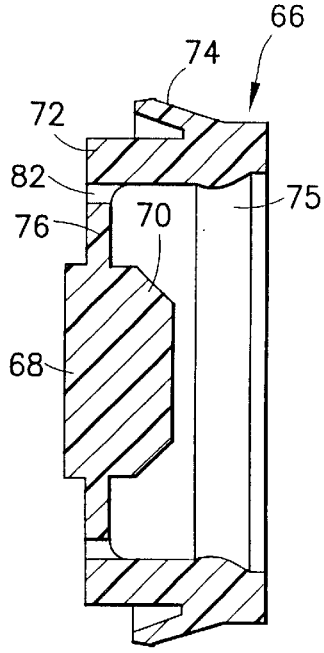
FIG. 4 is a sectional view of the check valve taken on the line 4—4 of FIG. 3.

As best shown in FIGS. 2, 3 and 4, the inlet valve sealing means comprises a wheel-like insert 66. The insert 66 is unitarily molded of a resilient plastic such as polyethylene. It comprises a central hub 68 having a downward frusto-conical valving surface 70 and a rim 72 to the lower end of which is formed an upward annular fin 74. The inner surface of the rim 72 is formed with an inward rib 75.

As shown in FIG. 3, the hub and rim of the insert are connected by a plurality of zig-zag spokes 76, each of which, as shown in FIG. 3, comprises an arcuate portion 78 concentric with the axis of the insert. The ends of portion 78 are connected to inner and outer radial portions 80, 82 respectively.

In assembly, the hub of the insert 66 is aligned with the seat 56. The rim is aligned with the annular trough 64 (FIG. 2) and moved downward. As the rim is inserted into the trough, the rib 75 engages the outward rib 60 on the boss in interference fit. When the rim is pressed farther toward the "home" position, the ribs 75 and 60 pass each other resulting in a snap fit engagement. This securing is enhanced by the outward pressure of the annular fin 74 on the inwardly facing wall 62 of the piston head.

As a result of the structure described, the downwardly facing frusto-conical surface 70 of the hub 68 can engage the inner edge of the seat 56 to seal and block downward flow of liquid. When, during the downward stroke of the piston, a negative pressure is created in the cylinder chamber, the hub 68 will rise permitting liquid in the passage of the stem 32 to enter into the chamber around valving surface 70. This raising of the hub 68 is made possible by the resilience of the spokes 76, particularly the arcuate portions 78 thereof which flex to permit the hub to rise.

The operation of the pump dispenser described herein is similar to that of the aforementioned patent application Ser. No. 09/298,596. From the downward position of the piston, the trigger 46, as shown in FIG. 1, may be pulled toward the closure 36 to raise the piston, forcing liquid in the cylinder chamber out delivery tube 18 and through the discharge check and the orifice 26. When the trigger is released, the spring 38 pulls the piston downward, creating a negative pressure in the cylinder chamber and causing the hub 68 of the insert to raise off the seat 54 drawing liquid from the tubular stem upward into the chamber. Upon the next retraction of the trigger 46, the piston will raise, causing the liquid, as well as the natural resilience of the spoke 78, to seat the bottom side of the hub 68 on the seat 54, driving the contents of the cylinder out the delivery tube 18.

As can be seen, the structure of the present invention permits the construction of an all-plastic pump dispenser, such that it may be processed for re-use of the plastic in a well- known manner. At the same time, the sealing member provides reliable operation for the discharge check valve. As compared to a ball-type check valve, the present invention reduces cost by removing metal, minimizing corrosion, and thereby further makes possible the use of the pump dispenser with corrosive liquids.

An advantage of having the piston seal a separate piece from the sealing valve is that these parts may be of different plastics respectively to optimize the characteristics of both parts, that is, the sealing valve to function best must be of a relatively more resilient plastic, such as medium density polyethylene, while the piston 50 peripheral seal engaging the cylinder must be of a relatively stiffer plastic, such as a high density polyethylene. The present invention enables such selection.

Variations in the invention are possible. Thus, while the invention has been shown in only one embodiment, it is not so limited but is of a scope defined by the following claim language which may be broadened by an extension of the right to exclude others from making, using or selling the invention as is appropriate under the doctrine of equivalents.

What is claimed is:

1. For a piston of a pump dispenser the piston having a head having a central cylindrical boss and a tubular stem terminating in a central opening in the boss, the opening having a seat and the boss being surrounded by an annular trough, an integrally formed inlet sealing valve insert molded of a resilient plastic attached to said piston head, said sealing valve insert comprising:

a. a peripheral rim portion secured in the annular trough, b. a hub portion movably aligned with the seat, said hub portion including a sealing surface which selectively is disposed in a liquid-tight seal position with the seat, and c. a plurality of resilient spokes connecting the rim and the hub.

2. A pump dispenser as claimed in claim 1 wherein the spokes are zig-zag in configuration, each comprising an arcuate portion concentric with the axis of the insert and radial portions connecting the opposite ends of the arcuate portion to the rim and the hub respectively.

3. A pump dispenser as claimed in claim 1 wherein the boss has an outward rib and the rim has an inward rib and the ribs interfere with each other in snap installation of the rim in the annular trough.

4. A pump dispenser as claimed in claim 1 wherein the rim has an outward and upward annular fin engaging the inward facing wall.

* * * * *